US009106010B2

(12) United States Patent
Jimbo et al.

(10) Patent No.: US 9,106,010 B2
(45) Date of Patent: Aug. 11, 2015

(54) CONNECTOR

(71) Applicant: YAZAKI CORPORATION, Tokyo (JP)

(72) Inventors: Tomoki Jimbo, Makinohara (JP); Yoshinao Sato, Makinohara (JP); Taro Inoue, Kikugawa (JP); Genfu Zeng, Kikugawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/016,615

(22) Filed: Sep. 3, 2013

(65) Prior Publication Data

US 2014/0004727 A1 Jan. 2, 2014

Related U.S. Application Data

(63) Continuation of application No. PCT/JP2012/056043, filed on Mar. 2, 2012.

(30) Foreign Application Priority Data

Mar. 4, 2011 (JP) ..... 2011-048331

(51) Int. Cl.
*H01R 13/595* (2006.01)
*H01R 9/22* (2006.01)
(Continued)

(52) U.S. Cl.
CPC ..... *H01R 13/595* (2013.01); *H01R 9/226* (2013.01); *H01R 13/506* (2013.01); *H01R 2105/00* (2013.01)

(58) Field of Classification Search
CPC .. H01R 9/226; H01R 2105/00; H01R 13/595; H01R 13/506
USPC ..... 439/76.2, 207–212, 110
See application file for complete search history.

(56) References Cited

U.S. PATENT DOCUMENTS 5,293,091 A * 3/1994 Edwards et al. ..... 361/611
6,220,874 B1 4/2001 Kurata et al.
(Continued)

FOREIGN PATENT DOCUMENTS

CN 1187266 A 7/1998
CN 1230802 A 10/1999
(Continued)

OTHER PUBLICATIONS

Search Report dated Jul. 23, 2012 issued in International Application No. PCT/JP2012/056043 (PCT/ISA/210).
(Continued)

*Primary Examiner* — Briggitte R Hammond
(74) *Attorney, Agent, or Firm* — Sughrue Mion, PLLC

(57) ABSTRACT

A connector includes a busbar, a housing and a cover. The busbar includes a first connection part extending in a first direction, a second connection part extending in a second direction opposite to the first direction at a position displaced from the first connection part in a direction orthogonal to the first direction, and a coupling part extending in a direction orthogonal to the first direction and the second direction and coupling the first connection part and the second connection part. The housing includes at least one accommodation groove accommodating the coupling part, and a slit through which one of the first connection part and the second connection part is inserted. The cover covers the accommodation groove.

5 Claims, 9 Drawing Sheets

(51) Int. Cl.
*H01R 13/506* (2006.01)
*H01R 105/00* (2006.01)

(56) References Cited

U.S. PATENT DOCUMENTS

| | | | | |
|---|---|---|---|---|
| 7,077,667 | B2 * | 7/2006 | Maebashi | 439/76.2 |
| 8,378,235 | B2 * | 2/2013 | Matsui | 439/76.2 |
| 2001/0009825 | A1 * | 7/2001 | Kasai | 439/724 |
| 2007/0010112 | A1 * | 1/2007 | Makino | 439/76.2 |
| 2009/0023345 | A1 | 1/2009 | Matsumoto et al. | |
| 2010/0285686 | A1 | 11/2010 | Lang et al. | |

FOREIGN PATENT DOCUMENTS

| | | | |
|---|---|---|---|
| DE | 10 2006 052 119 | A1 | 5/2008 |
| EP | 1 796 221 | A1 | 6/2007 |
| JP | 1-166419 | U | 11/1989 |
| JP | 2-207466 | A | 8/1990 |
| JP | 2005-347059 | A | 12/2005 |
| JP | 2006-81373 | A | 3/2006 |
| JP | 2010-508646 | A | 3/2010 |
| WO | 9642124 | A1 | 12/1996 |
| WO | 2006/030732 | A1 | 3/2006 |

OTHER PUBLICATIONS

Written Opinion dated Jul. 23, 2012 issued in International Application No. PCT/JP2012/056043 (PCT/ISA/237).

Office Action dated Sep. 24, 2014 issued by the Japanese Patent Office in counterpart Japanese Patent Application No. 2011-048331.

Office Action dated Jun. 3, 2015, issued by the State Intellectual Property Office of P.R. China in counterpart Chinese Application No. 201280011745.7 English Translation.

* cited by examiner

CONNECTOR

CROSS REFERENCE TO RELATED APPLICATIONS

This application is a continuation of PCT application No. PCT/JP2012/056043, which was filed on Mar. 2, 2012 based on Japanese Patent Application (No. 2011-048331) filed on Mar. 4, 2011, the contents of which are incorporated herein by reference.

BACKGROUND OF THE INVENTION

1. Field of the Invention

The present invention is related to a connector, and more particularly to a connector for direct installation on an inverter for driving two three-phase AC motors in an electric vehicle by one inverter.

2. Description of the Related Art

The connector for direct installation on the inverter for driving two motors by one inverter is known (refer to PTL1).

FIGS. 8A and 8B are diagrams illustrating a function of the connector for direct installation, in which FIG. 8A is a circuit diagram around the connector, and FIG. 8B is a perspective view illustrating a connector structure.

In FIGS. 8A and 8B, a DC voltage from a battery Ba is applied to an inverter INV within an inverter case 100 through a plus line P and a minus line N, and the DC voltage is inverted into three-phase AC voltages of U phase, V phase, and W phase in the inverter INV. A U-phase voltage, a V-phase voltage, and a W-phase voltage of the three phases inverted by the inverter INV are output to a busbar terminal U, a busbar terminal V, and a busbar terminal W, respectively. In order to apply the U-phase voltage, the V-phase voltage, and the W-phase voltage to respective motors M01 and M02, the busbar terminal U, the busbar terminal V, and the busbar terminal W are each branched into two busbar terminals. Accordingly, the busbar terminal U is branched into busbar terminal U1 and busbar terminal U2, the busbar terminal V is branched into busbar terminal V1 and busbar terminal V2, and the busbar terminal W is branched into busbar terminal W1 and busbar terminal W2. The U-phase voltage is output from the busbar terminal U1 and the busbar terminal U2 in the inverter case 100, the V-phase voltage is output from the busbar terminal V1 and the busbar terminal V2, and the W-phase voltage is output from the busbar terminal W1 and the busbar terminal W2. In a connector for direct installation 200 that is installed directly on the inverter case 100, the busbar terminal U1 and the busbar terminal U2, the busbar terminal V1 and the busbar terminal V2, and the busbar terminal W1 and the busbar terminal W2 from the inverter case 100 are collected into two busbar terminal group 1 (busbar terminal U1, busbar terminal V1, busbar terminal W1) and group 2 (busbar terminal U2, busbar terminal V2, busbar terminal W2). The former is output from a connector 201, and the latter is output from a connector 202. The U-phase voltage, the V-phase voltage, and the W-phase voltage output from the busbar terminal U1, the busbar terminal V1, and the busbar terminal W1 of the connector 201, respectively, enter a motor side terminal T1 through a line U1, a line V1, and a line W1, form a rotating magnetic field in the motor M01, and drive a rotor.

Likewise, the U-phase voltage, the V-phase voltage, and the W-phase voltage output from the busbar terminal U2, the busbar terminal V2, and the busbar terminal W2 of the connector 202, respectively, enter a motor side terminal T2 through a line U2, a line V2, and a line W2, form a rotating magnetic field in the motor M02, and drive a rotor.

Thus, the respective terminals enter an inlet of the connector 200 in the order of the busbar terminal U1 and the busbar terminal U2, the busbar terminal V1 and the busbar terminal V2, and the busbar terminal W1 and the busbar terminal W2. The connector 200 finally rearranges those respective terminals into one group including the busbar terminal U1, the busbar terminal V1, and the busbar terminal W1, and the other group including the busbar terminal U2, the busbar terminal V2, and the busbar terminal W2 by efficiently arranging the busbars, and outputs voltages via those terminals from an outlet of the inverter case 100.

FIG. 9 is a diagram illustrating a configuration of a busbar within the connector 200 disclosed in PTL1. The connector 200 includes six busbar terminals U1, U2, V1, V2, W1, and W2 (hereinafter called "U1 to W2") routed in the inverter case 100. Terminal parts of six busbar terminals U1 to W2 are arranged in parallel in the order of U1, U2, V1, V2, W1, and W2 from right of the drawing.

A horizontal terminal part of the rightmost busbar terminal U1 is continuous to an upward short vertical portion, and bent with a step in substantially an L-shape upward through a horizontal short plate to form a rightmost vertical terminal.

The second right busbar terminal U2 is bent downward, shortly, and vertically through a horizontal portion, and extends long in substantially a crank shape toward left. A left edge thereof is upward vertical, and bent with a step in substantially an L-shape through a horizontal short plate to form a second left vertical terminal.

The third right busbar terminal V1 has an upward short vertical part from a horizontal portion, and is bent with a step in substantially an L-shape through a horizontal short plate to form a third vertical terminal.

The fourth right busbar terminal V2 is continuous to an upward short vertical portion from a horizontal portion, and bent with a step in substantially an L-shape through a horizontal short plate to form a fourth right vertical terminal.

The third and fourth right busbar terminals V1 and V2 are bilaterally symmetrically formed.

The fifth right busbar terminal W1 is bent downward, slightly long, and vertically through a horizontal portion, and extended long in substantially a crank shape toward right. A right edge thereof is an upward vertical part, and bent with a step in substantially an L-shape through a horizontal short plate to form a second right vertical terminal.

The sixth right (left edge) busbar terminal W2 is bent with a step in substantially an L-shape upward through a horizontal short plate from an upward short vertical portion through a horizontal portion to form a leftmost vertical terminal.

As described above, a busbar assembly of the connector 200 is configured.

As illustrated in FIG. 10, in the busbar assembly, among the six busbar terminals U1, U2, V1, V2, W1, and W2, the three busbar terminals U1, U2, and V1 on the lower left side are fixed by one horizontally long insulating block. The three busbar terminals V2, W1, and W2 on the lower right side are fixed by one horizontally long insulating block. Those two insulating blocks are arranged in parallel within one horizontally long shield shell.

Also, the three busbar terminals U1, V1, and W1 on the upper left side are arranged a connector fitting chamber of one connector 201, and the three busbar terminals U2, V2, and W2 on the right side are arranged a connector fitting chamber of the other connector 202. Those six electric wires of the connectors 201 and 202 are bundled and continuous to connectors T1 and T2 on the motors M01 and M02 (FIG. 8B) side.

According to the connector 200 disclosed in PTL1, the inverter can be downsized, and moreover connection with the inverter can be ensured easily and efficiently.

When the busbar terminals of the connector for direct installation are integrally molded with the insulating resin part, the alignment (horizontality) of the busbar terminals U1, V1, W1, the busbar terminals U2, V2, W2, the busbar terminals U1, U2, the busbar terminals V1, V2, and the busbar terminals W1, W2 may not be ensured, depending on the dimensional relationships or the manufacturing problems of the busbar terminals on the single terminal basis.

Further, even in a state where the alignment of the busbar terminals of the connector for direct installation is ensured, the alignment of the partner connectors 201 and 202 may not be ensured.

Thus, when the connector 200 disclosed in PTL1 is fastened to the partner connectors 201 and 202 under the circumstance where the alignment is not ensured, a load is exerted on a fastening part of the connector 200, resulting in a risk of an adverse effect that a bolt is loosened when bolt fastening is conducted.

CITATION LIST

Patent Literature

[PTL1] JP-A-2006-81373

SUMMARY OF THE INVENTION

It is therefore one advantageous aspect of the present invention to provide a connector for direct installation in which no load is exerted on a fastening part of the connector when a partner connector is fastened thereto even if the respective alignments of busbar terminal groups of the connector is not ensured.

According to one advantage of the invention, there is provided a connector comprising:

- a busbar including:
  - a first connection part extending in a first direction; and
  - a second connection part extending in a second direction opposite to the first direction at a position displaced from the first connection part in a direction orthogonal to the first direction; and
- a coupling part extending in a direction orthogonal to the first direction and the second direction, and coupling the first connection part and the second connection part;
- a housing including at least one accommodation groove accommodating the coupling part, and a slit through which one of the first connection part and the second connection part is inserted; and
- a cover covering the accommodation groove.

The connector may further comprise a plurality of the busbars, each of which including the first connection part, the second connection part, and the coupling part, wherein the plurality of busbars sterically intersect with each other along the accommodation groove within the housing so that an alignment order of the busbars in the first connection part is different from an alignment order of the busbars in the second connection part.

The connector may be configured such that: the housing includes at least two accommodation grooves accommodating the coupling part respectively, and the accommodation grooves are formed in opposite sides of the housing respectively.

According to another advantage of the invention, there is provided a connector for direct installation on an inverter which is installed directly on the inverter for driving two three-phase loads by one inverter, the connector comprising:

- six busbars having flat and elongated shape;
- a housing formed with three narrow elongated spaces so as to accommodate the six busbars therein;
- an upper cover covering a top of the housing in a vertical direction; and
- an under cover covering a bottom of the housing in the vertical direction,
- wherein each of the busbars includes a first busbar terminal, a second busbar terminal extending in a direction opposite to that of the first busbar terminal, and a coupling busbar coupling the first busbar terminal and the second busbar terminal,
- wherein the coupling busbar is connected to the first busbar terminal perpendicularly, extends by a predetermined length in a plane, turns perpendicularly and extends in the plane, turns perpendicularly to a opposite side with respect to the first busbar terminal in the plane, extends by a predetermined length, and is connected to the second busbar terminal perpendicularly,
- wherein two of the narrow elongated spaces are arranged in parallel with each other with an interval in a cross section orthogonal to an elongating direction thereof, and the other one of the narrow elongated spaces is arranged in a plane in which one of the two narrow elongated spaces is arranged at a side of the under cover, and
- wherein the coupling busbars are accommodated in the narrow elongated spaces with a clearance in a widthwise direction which is orthogonal to the elongating direction, so that both of the first busbar terminal and the second busbar terminal move in the vertical direction within the housing.

The coupling busbars of the busbars for a U phase and a W phase among the six busbars may be accommodated in the two narrow elongated spaces arranged in parallel, and the coupling busbars of the busbars for a V phase may be accommodated in the other one of the narrow elongated spaces.

According to the present invention, the busbars do not need to be insert-molded, and are inserted in the grooves along the surfaces of the coupling part. Therefore, the terminals are easily positioned with respect to a structure of a divided housing that holds the coupling parts from both sides thereof.

According to the present invention, there is required no jig for ensuring an insulating distance between the busbars at the time of conducting the insert molding. Also, when a sterical intersection is conducted in the structure of the divided housing that holds the coupling parts from both sides thereof, there is a need to further provide an insulating member therebetween. On the contrary, the present invention does not require the insulating member.

According to the present invention, even when the number of busbars is increased, and the busbars complicatedly intersect with each other, the busbars are inserted from both ends of the housing so that insulation can be ensured in a planar direction and the widthwise direction of the coupling part. Also, when the sterical intersection is conducted in the structure of the divided housing that holds the coupling parts from both sides thereof, there is a need to further provide the insulating member therebetween. On the contrary, the present invention does not require the insulating member.

According to the present invention, even when each alignment of the busbar terminal groups of the connector for direct installation cannot be conducted, when the connector is fastened to the partner connector, the busbar terminals can move vertically within the housing. Therefore, because a design error is absorbed by the busbar terminals, no load is exerted on the fastening part of the connector for direct installation.

According to the present invention, the respective busbars can be efficiently arranged within the thin elongated housing.

BRIEF DESCRIPTION OF THE DRAWINGS

FIGS. 6A and 6B are perspective views illustrating a complete state in which the housing is covered with the outer cover and the lower cover of FIG. 5, in which FIG. 6A is a perspective view from a center busbar terminal side, and FIG. 6B is a perspective view from an end busbar terminal side.

FIGS. 8A and 8B are diagrams illustrating a function of the connector for direct installation, in which FIG. 8A is a circuit diagram of a periphery of the connector, and FIG. 8B is a perspective view illustrating a connector structure.

DETAILED DESCRIPTION OF THE EXEMPLARY EMBODIMENTS

Hereinafter, a connector in which there is no need to subject busbars to insert molding, and terminals are easily positioned with respect to a structure of a divided housing that holds coupling parts from both sides thereof will be described on the basis of an embodiment of a specific connector for direct installation with reference to FIGS. 1 to 7.

Figure 1:
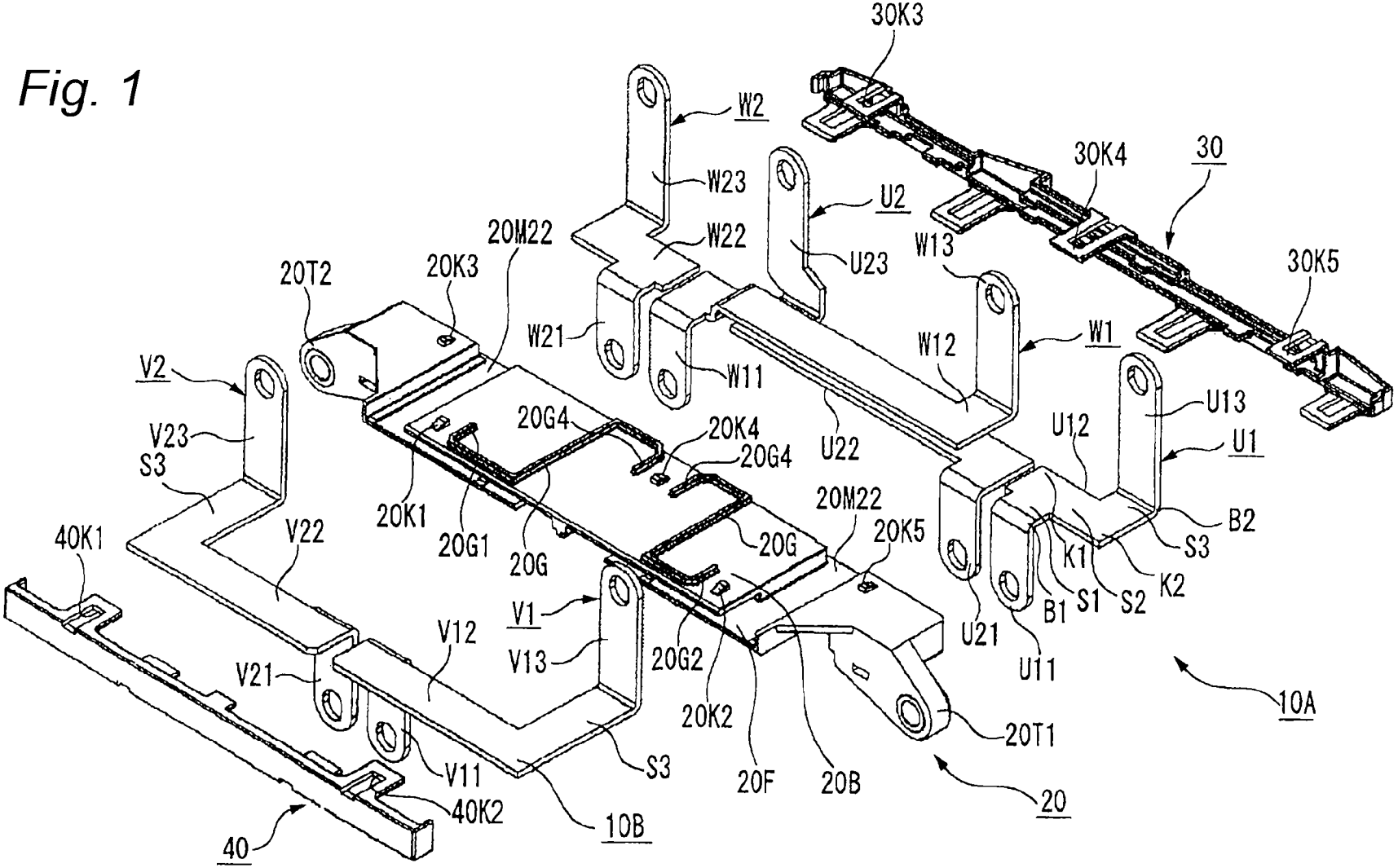
FIG. 1 is an exploded perspective view of a connector for direct installation according to the present invention.

FIG. 1 is an exploded perspective view of a connector for direct installation according to the present invention. Referring to FIG. 1, the connector includes an upper cover 30, a first busbar terminal group 10A, a housing 20, a second busbar terminal group 10B, and an under cover 40 in order from right.

Hereinafter, a description will be given of a busbar terminal group 10 which includes the first busbar terminal group 10A and the second busbar terminal group 10B, the housing 20, the upper cover 30, and the under cover 40 in the stated order.

Referring to FIGS. 1 to 7, according to this embodiment, the busbar terminal group 10 includes six busbars in total, that is, a U-phase first terminal U1 and a U-phase second terminal U2, a V-phase first terminal V1 and a V-phase second terminal V2, and a W-phase first terminal W1 and a W-phase second terminal W2.

Among those terminals, the U-phase first terminal U1 and the U-phase second terminal U2, and the W-phase first terminal W1 and the W-phase second terminal W2 configure the first busbar terminal group 10A, and the V-phase first terminal V1 and the V-phase second terminal V2 configure the second busbar terminal group 10B.

The busbar terminals in the busbar terminal group 10 are common in basic configuration to each other, and therefore a configuration of the U-phase first terminal U1 (busbar terminal U1) will be exemplified.

Figure 2:
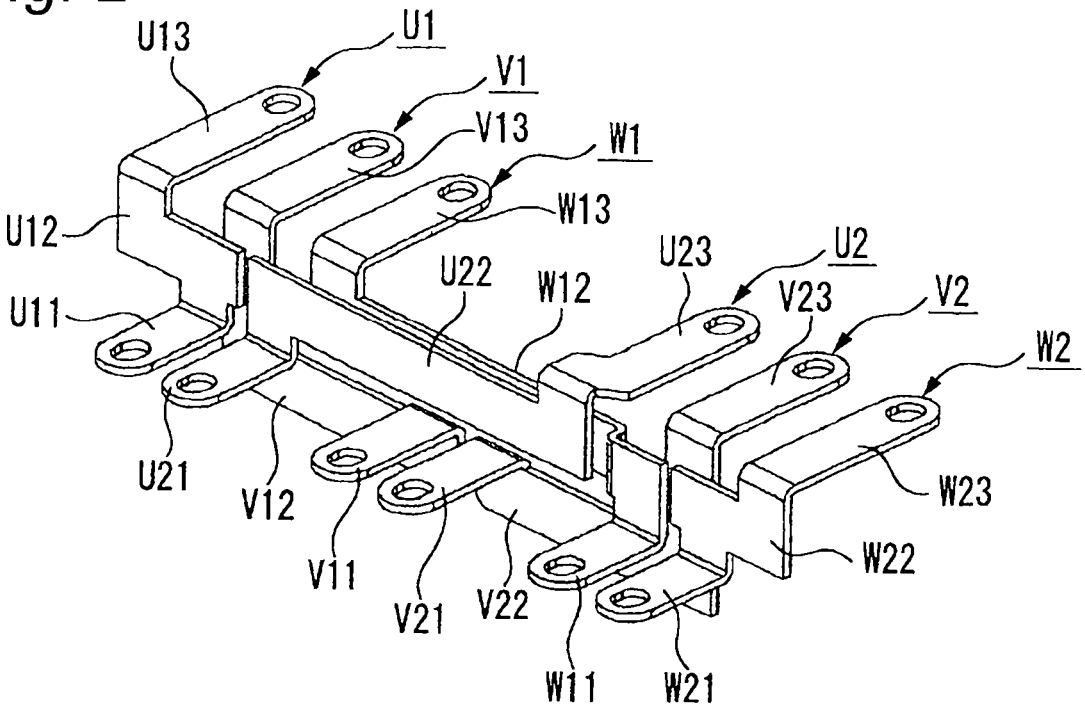
FIG. 2 is a perspective view illustrating a state in which only six busbars are assembled according to the present invention.
Figure 3:
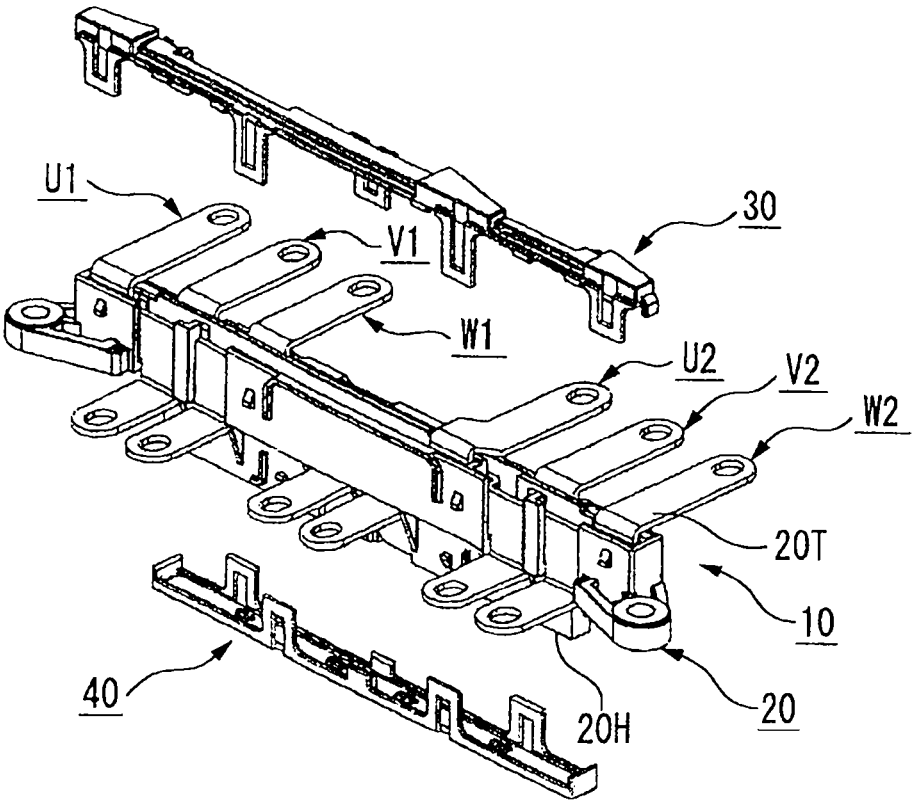
FIG. 3 is a perspective view illustrating a state in which the six busbars of FIG. 2 are accommodated in a housing.

The U-phase first terminal U1 includes a center busbar terminal U11 (FIGS. 2 and 7) that extends perpendicular to a housing surface from a neighborhood of a center line extending through a center of a short axis of the housing 20 in a long direction, an edge busbar terminal U13 (FIGS. 2 and 7) that extends perpendicular to an opposite surface of the housing surface from a longitudinal margin of the housing 20 in an opposite direction of the center busbar terminal, and a coupling busbar U12 (FIG. 2) that couples the center busbar terminal U11 and the edge busbar terminal U13, in a complete state where the U-phase first terminal U1 is assembled into the thin elongated housing 20 (FIG. 2).

Further, the coupling busbar U12 includes a first bent part B1 (FIG. 1) that is bent at 90° on an edge of the center busbar terminal U11, a first straight part S1 (FIG. 1) that straight extends from the first bent part B1, a first direction turn part K1 (FIG. 1) that turns in the long direction of the housing 20 into a 90° crank shape on an edge of the first straight part S1, a second straight part S2 (FIG. 1) that straight extends from the first direction turn part K1 in the long direction of the housing 20, a second direction turn part K2 (FIG. 1) that turns in an opposite direction to that of the first direction turn part K1 from the long direction of the housing 20 into the 90° crank shape on an edge of the second straight part S2, a third straight part S3 (FIG. 1) that straight extends from the second direction turn part K2 in the edge busbar terminal direction, and a second bent part B2 (FIG. 1) that is bent on an edge of the third straight part S3 and coupled to the edge busbar terminal U13.

All of the coupling busbars U12, U22, V12, V22, W12, W22 are identical in the configuration with the U-phase first terminal U1 in principle. Only lengths and directions of the coupling busbars U12, U22, V12, V22, W12, W22 are different from those of the U-phase first terminal U1. Each of the coupling busbars U12, U22, V12, V22, W12, W22 includes the first bent part B1 that is bent at 90° on the edge of the center busbar terminal U11, U21, V11, V21, W11, W21, the first straight part S1 that straight extends from the first bent part B1, the first direction turn part K1 that turns in the long direction of the housing 20 into the 90° crank shape on the edge of the first straight part S1, the second straight part S2 that straight extends from the first direction turn part K1 in the long direction of the housing 20, the second direction turn part K2 that turns in the opposite direction to that of the first direction turn part K1 from the long direction of the housing 20 into the 90° crank shape on the edge of the second straight part S2, the third straight part S3 that straight extends from the second direction turn part K2 in the edge busbar terminal direction (U13, U23, V13, V23, W13, W23), and the second bent part B2 that is bent on the edge of the third straight part S3 and coupled to the edge busbar terminal.

Differences between the busbar terminal group 10A and the busbar terminal group 10B reside in a bent direction of the first bent part B1, and a length of the third straight part S3.

The first bent part B1 of the busbar terminal group 10A is bent toward the upper cover 30 side whereas the first bent part B1 of the busbar terminal group 10B is bent toward the under cover 40 side.

The length of the third straight part S3 of the busbar terminal group 10A is equal to or shorter than half of a length of the housing 20 in a short axial direction thereof in a state where the third straight part S3 of the busbar terminal group 10A is assembled into the housing 20 whereas the length of the third straight part S3 of the busbar terminal group 10B is equal to the length of the housing 20 in the short axial direction thereof.

Referring to FIGS. 1 to 7, the U-phase first terminal U1 and the W-phase second terminal W2 are basically symmetric with respect to a center line extending through a center of a long axis of the housing 20 in a short direction.

The U-phase second terminal U2 and the W-phase first terminal W1 are also basically symmetric with respect to a center line extending through a center of a long axis of the housing 20 in the short direction. In arrangement, since the respective second straight parts S2 are located to collide with each other, only one second straight part S2 (S2 of W12 in FIG. 1) is so configured as to be bent upward to avoid collision.

The center busbar terminals (U11, U21) of the respective first and second terminals of the U phase, and the center busbar terminals (W11, W21) of the respective first and second terminals of the W phase are arranged on the same plane M1 (FIG. 7) (refer to FIG. 2).

The edge busbar terminals (U13, U23) of the respective first and second terminals of the U phase, and the edge busbar terminals (W13, W23) of the respective first and second terminals of the W phase are arranged on the same plane M2 (FIG. 7) (refer to FIG. 2).

All of the coupling busbars (U12, U22, W12, W22) of the respective first and second terminals of the U phase and the W phase are arranged on the same plane M3 except for the second straight part S2, the second direction turn part K2, and the third straight part S3 of the W-phase first terminal W12. The second straight part S2, the second direction turn part K2, and the third straight part S3 of the W-phase first terminal W12 are arranged on the same plane M4 (FIG. 7).

The second busbar terminal group 10B includes a V-phase first terminal V1 and a V-phase second terminal V2.

Referring to FIG. 1, the V-phase first terminal V1 and the V-phase second terminal V2 are symmetric with respect to the center line extending through a center of a long axis of the housing 20 in the short direction.

Figure 7:
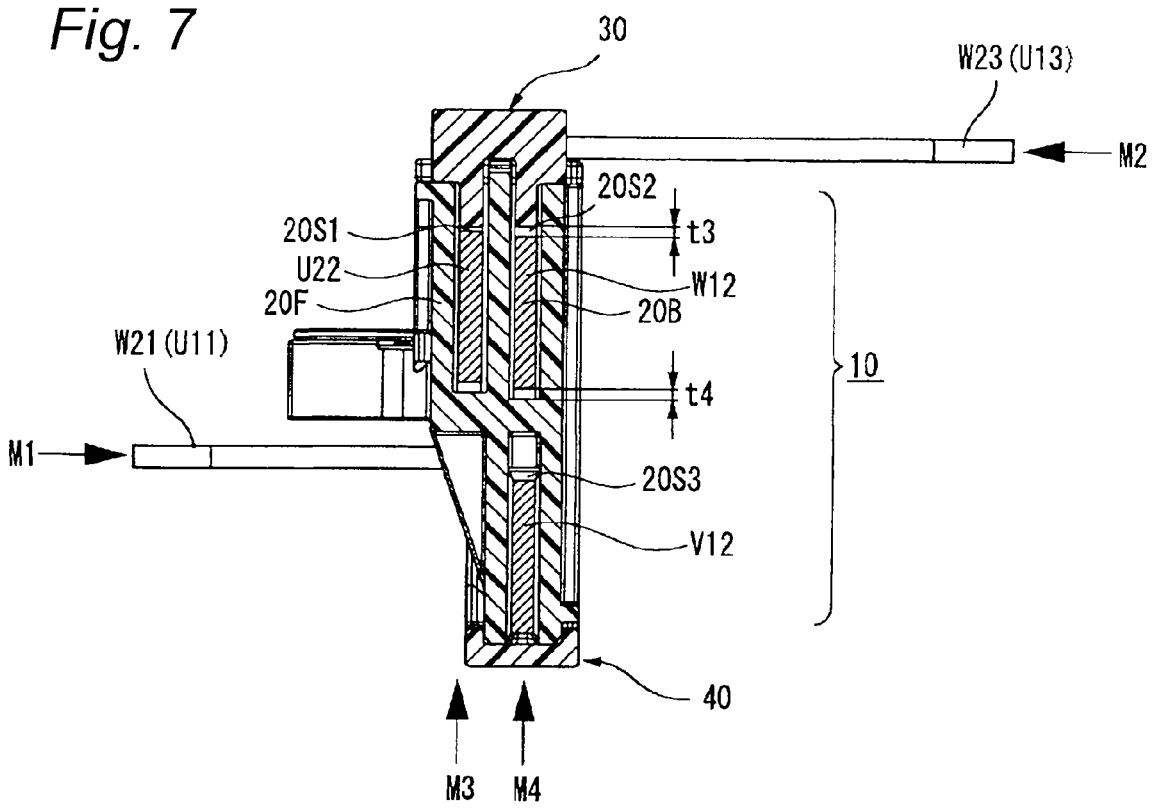
FIG. 7 is a vertical cross-sectional view of the connector for direct installation in the complete state of FIGS. 6A and 6B.
Figure 8A:
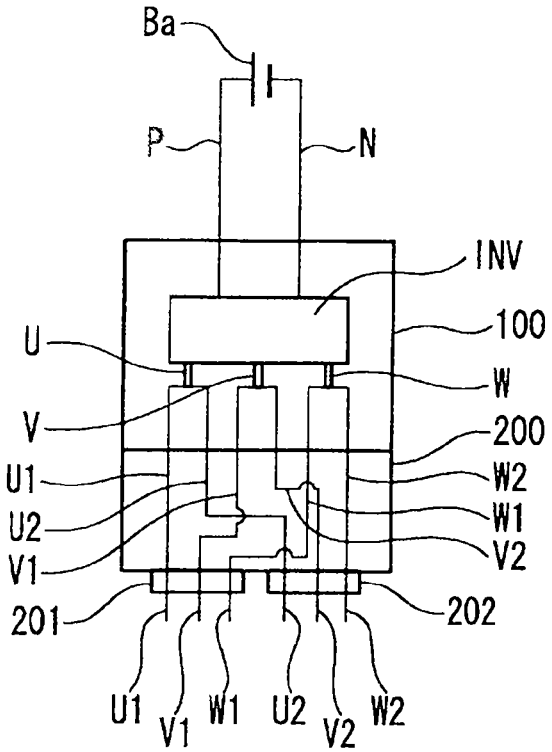
Figure 8B:
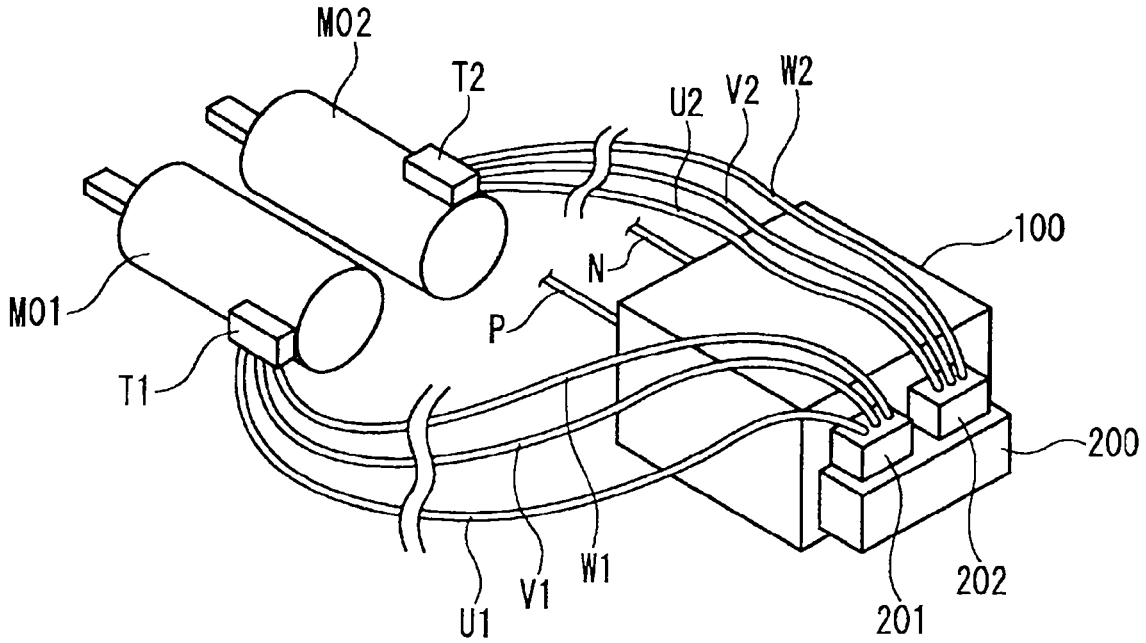
Figure 9:
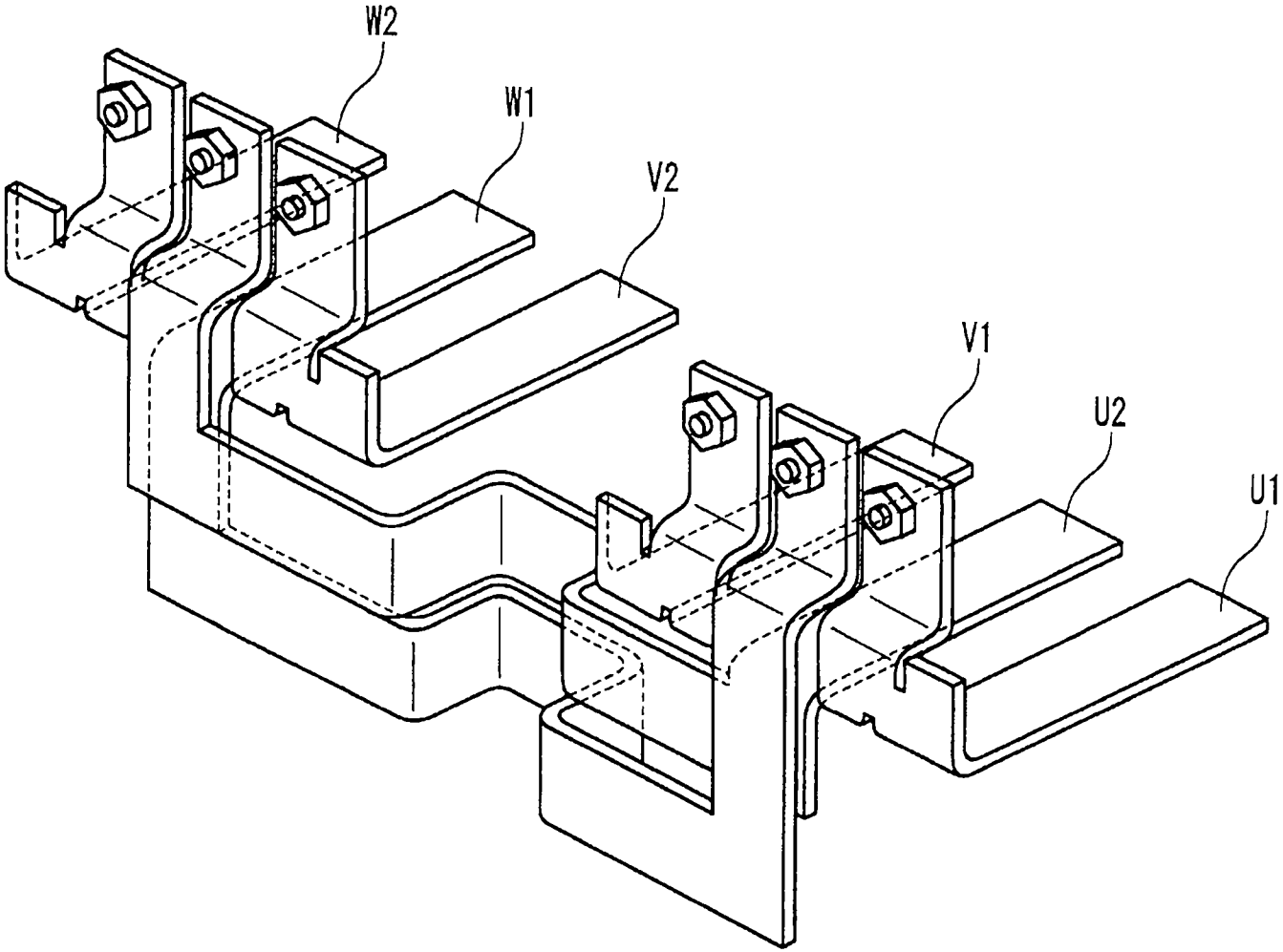
FIG. 9 is a diagram illustrating a configuration of busbars within a connector 200 disclosed in PTL1.
Figure 10:
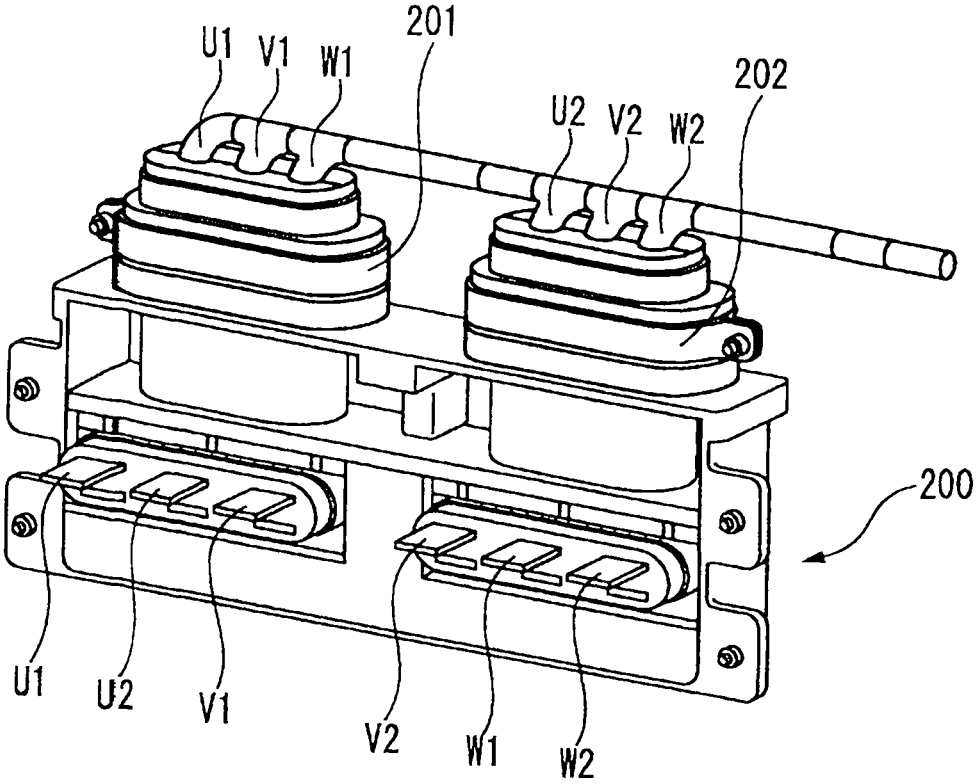
FIG. 10 is a perspective view illustrating the connector for direct installation integrally molded with an insulating resin disclosed in PTL1.

The center busbar terminals (V11, V21) of the first and second terminals of the V phase are arranged on the plane M1 (FIG. 7).

The edge busbar terminals (V13, V23) of the first and second terminals of the V phase are arranged on the same plane M2 (FIG. 7).

The coupling busbar terminals (V12, V22) of the first and second terminals of the V phase are arranged on the above plane M4 (FIG. 7).

As illustrated in FIG. 1, the housing 20 is formed of a thin elongated insulator in which the following three narrow elongated spaces 20S1, 20S2, and 20S3 (FIG. 7) are formed in a portion sandwiched between one long surface 20B (FIGS. 4, 7) and a long surface 20F (FIGS. 4, 7) on an opposite side thereof.

The first space 20S1 is a portion where the coupling busbar U22 group is accommodated in FIG. 7. The first space 20S1 is a chamber arranged in the long direction, which accommodates the coupling busbar U12 of the U-phase first terminal, the coupling busbar U22 of the U-phase second terminal, the first direction turn part K1 of the W-phase first terminal W12, and the coupling busbar W22 of the W-phase second terminal, which are aligned on the plane M3. Gaps between the respective busbars are partitioned by insulating ribs.

The second space 20S2 is a portion where the coupling busbar W12 group is accommodated in FIG. 7, which is a chamber arranged in the long direction, which accommodates the coupling busbar W12 and the second direction turn part K2 of the W-phase first terminal W12 on the plane M4 therein. A gap between the first space and the second space is partitioned by an insulating rib.

The third space 20S3 is a portion where the coupling busbar V12 group is accommodated in FIG. 7. The third space 20S3 includes a chamber arranged in the long direction, which accommodates the coupling busbar V12 of the V-phase first terminal V1 and the coupling busbar V22 of the V-phase second terminal V2, which are aligned on the plane M4, and a chamber arranged in the short direction, which accommodates the third straight part S3 of the coupling busbar V12 of the V-phase first terminal V1 and the third straight part S3 of the coupling busbar V22 of the V-phase second terminal V2, which turn at a right angle to the former chamber from both ends thereof. A gap between the first space and the third space, and a gap between the second space and the third space are each partitioned by an insulating rib.

Figure 4:
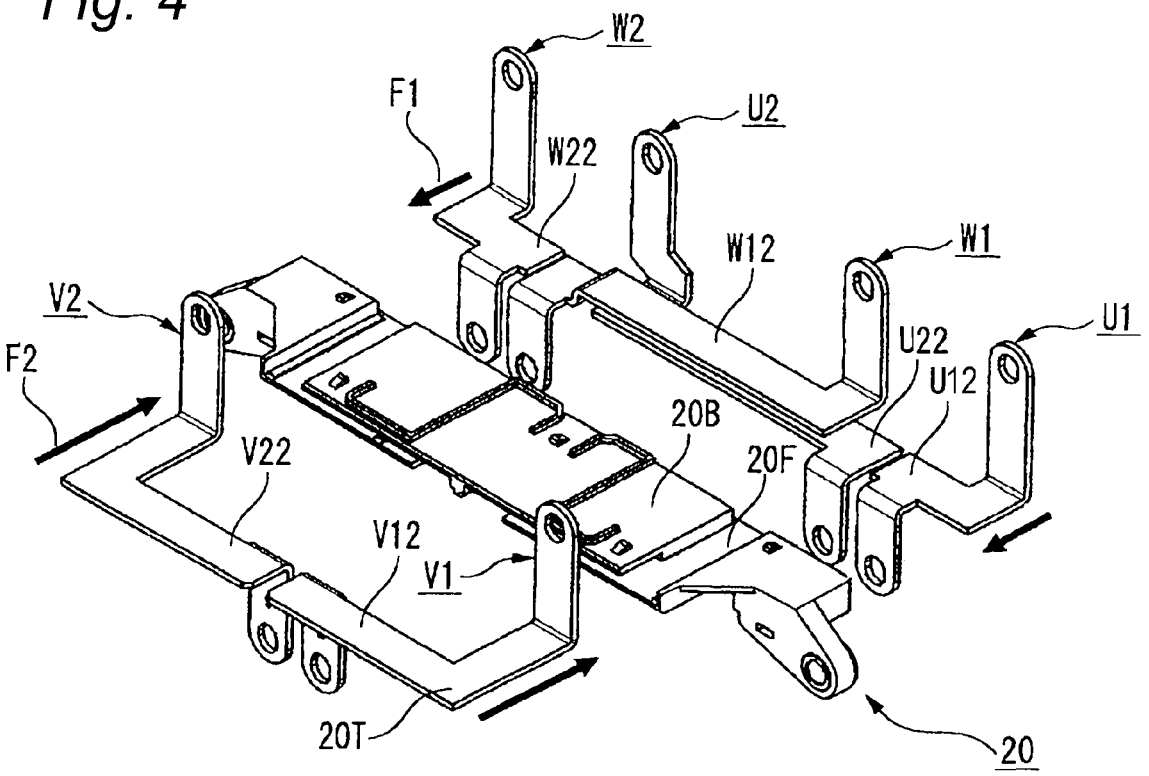
FIG. 4 is a perspective view illustrating a state immediately before a busbar terminal group A and a busbar terminal group B are inserted into the housing.

At the portion sandwiched between the long surface 20B and the long surface 20F, all of the coupling busbars (U12, V12, W12, U22, V22, W22) of the U, V, and W phases are inserted and accommodated into those three narrow elongated spaces 20S1, 20S2, and 20S3 from arrows indicated in FIG. 4.

That is, the coupling busbars (U12, W12, U22, W22) of the U phase and the W phase are inserted from a direction of an arrow F1 in FIG. 1. However, among the coupling busbars of the U phase and the W phase, the three coupling busbars (U12, U22, W22) are inserted in a lower space (first space 20S1 in FIG. 7) of the housing in FIG. 4, and the coupling busbar (W12) of the W-phase first terminal is inserted into an upper space (second space 20S2 in FIG. 7) of the housing in FIG. 4.

Also, the coupling busbars (V12, V22) of the V phase are inserted into an upper space (third space 20S3 in FIG. 7) of the housing in FIG. 4 from a direction of an arrow F2 in FIG. 4. The housing 20 is provided with spaces 20M22 and 20M22 (FIG. 1) in which the third straight parts S3 of the coupling busbars (V12, V22) of the V phase are accommodated as parts of the third space.

The center busbar terminals (U11, U21, V11, V21, W11, W21) extending from the coupling busbars accommodated in the spaces are exposed from a lower portion of the long surface 20F (FIG. 7) in the horizontal direction. Also, the edge busbar terminals (U13, U23, V13, V23, W13, W23) extending from the coupling bas bars accommodated in the spaces toward the opposite side are exposed from an upper portion of the long surface 20B (FIG. 7) horizontally in the opposite direction to that of the center busbar terminals.

Figure 5:
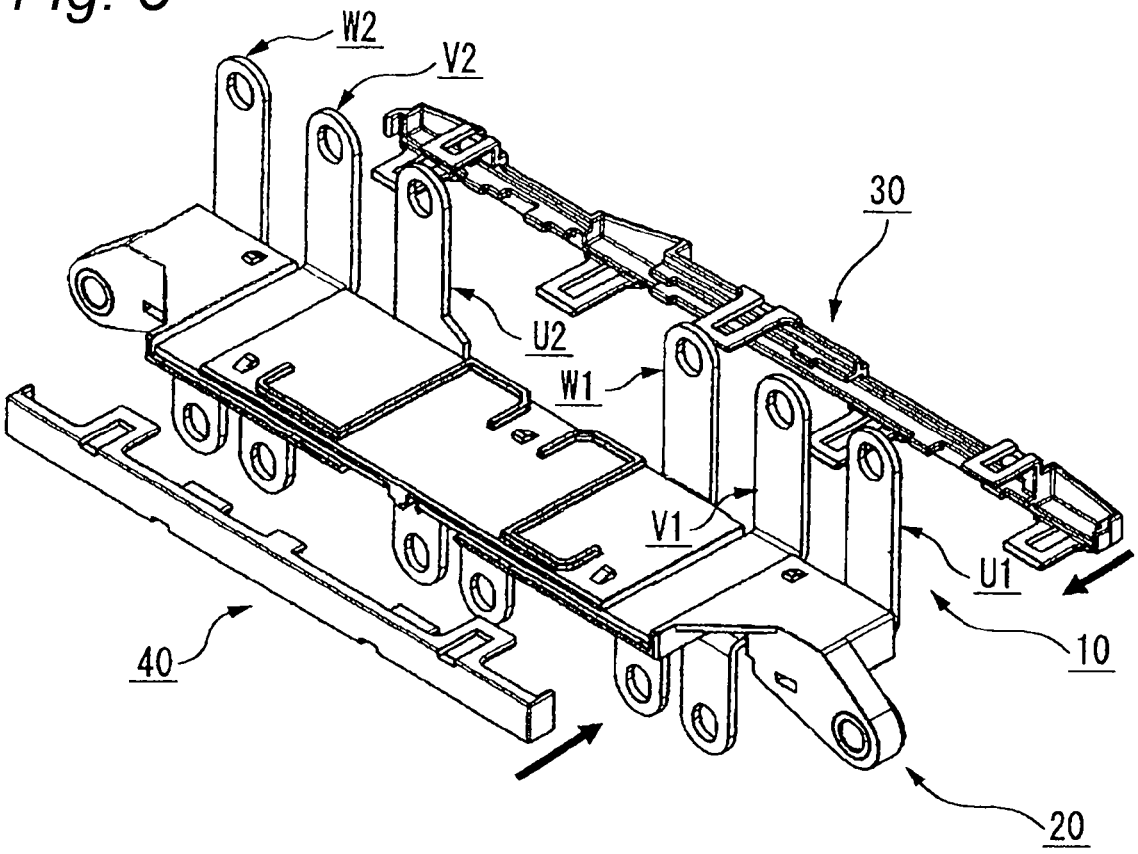
FIG. 5 is a perspective view illustrating a state immediately after the busbar terminal group A and the busbar terminal group B in FIG. 4 are inserted into the housing, but immediately before the housing is covered with an outer cover and a lower cover.

FIG. 5 illustrates a state of the six busbars having the configuration according to the present invention, which are thus inserted into the housing 20 and supported.

Figure 6A:
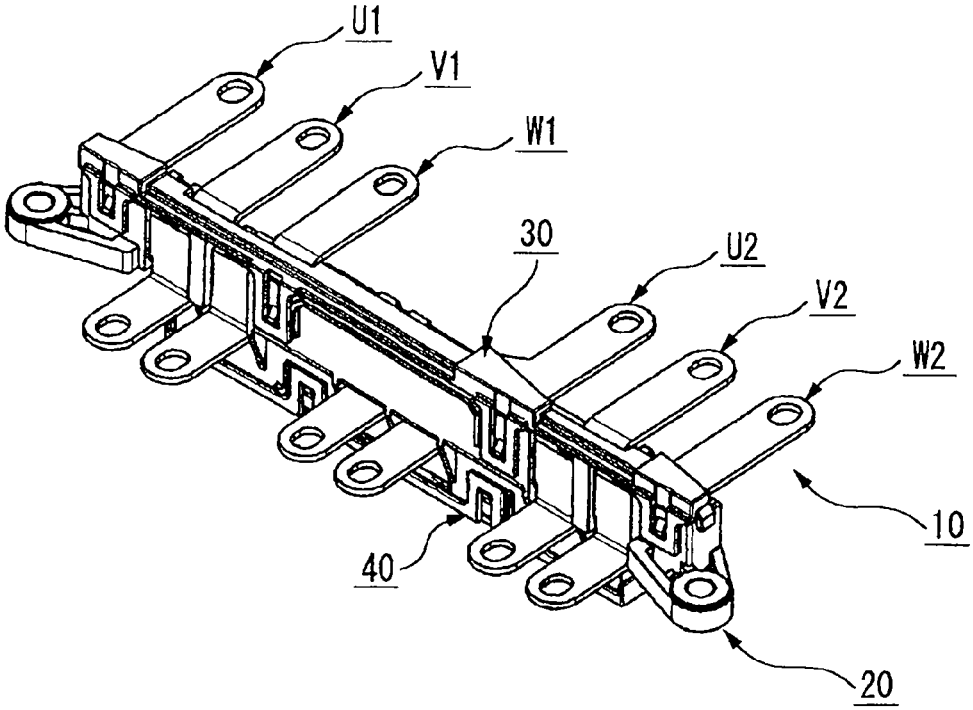
Figure 6B:
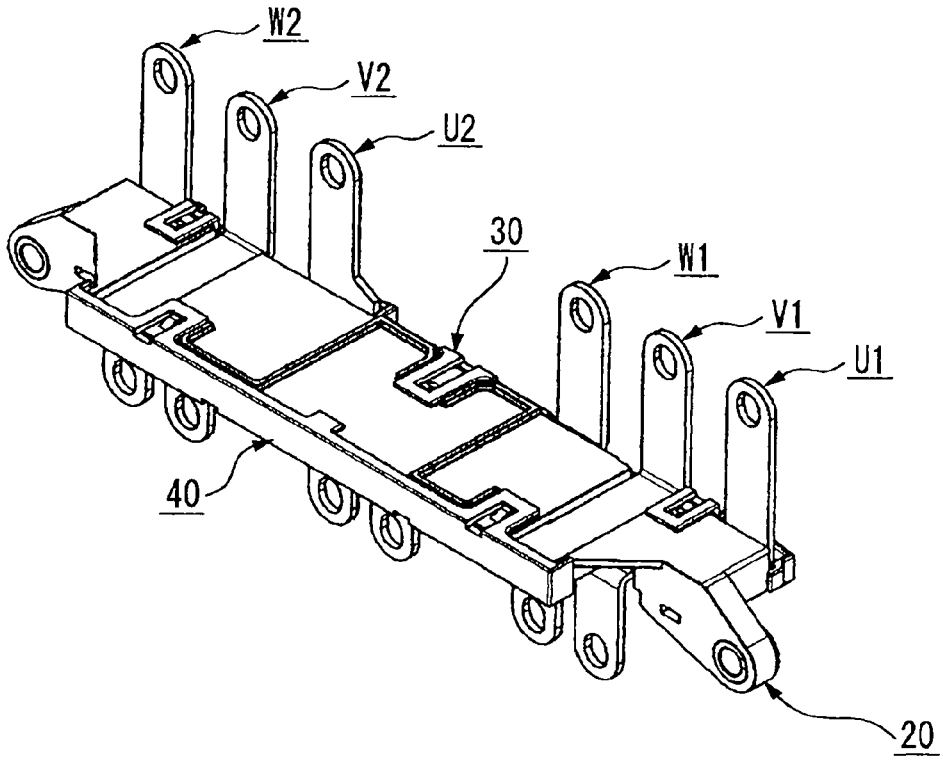

When the upper cover 30 and the under cover 40 are engaged with the upper portion and the lower portion of the housing 20, respectively, as described below, the connector for direct installation according to the present invention is completed as illustrated in FIGS. 6A and 6B.

The outside of the housing 20 is equipped with engagement projections 20K3 to 20K5 on a portion engaged with the upper cover 30, and engagement projections 20K1 and 20K2 on sites engaged with the under cover 40.

The upper cover 30 is made of insulator, and provided with engagement holes 30K3 to 30K5 on sites engaged with the engagement projections 20K3 to 20K5 outside of the housing 20. The engagement projections 20K3 to 20K5 of the housing 20 are engaged with the engagement holes 30K3 to 30K5 of the upper cover 30 as illustrated in FIGS. 6A and 6B, as a result of which the upper cover 30 covers the housing 20, the coupling busbars U12, U22, and W22 are not removed from the first space 20S1 (FIG. 7), and the coupling busbar W12 is not removed from the second space 20S2 (FIG. 7).

The under cover 40 is made of insulator, and provided with engagement holes 40K1 and 40K2 on sites engaged with the engagement projections 20K1 and 20K2 outside of the housing 20. The engagement projections 20K1 and 20K2 of the housing 20 are engaged with the engagement holes 40K1 and 40K2 of the under cover 40 as illustrated in FIGS. 6A and 6B, as a result of which the under cover 40 covers the housing 20, the coupling busbars V12 and V22 are not removed from the third space 20S3.

According to the present invention, as illustrated in FIG. 7, the thick portions of the busbars are inserted into the narrow spaces of the thin elongated housing 20, and covered with the upper cover 30. With this configuration, the internal accommodation spaces are set to be larger than the width dimensions of the busbars by clearances t3 and t4 so that the busbars can move vertically within the spaces.

Likewise, the accommodation spaces formed by the under cover 40 are set to be larger than the busbar dimensions so as to provide clearances.

Thus, when the thick portions of the busbars having the creative configuration are inserted into the narrow spaces of the thin elongated housing 20, and covered, the clearances are formed in which the busbars slightly move within the space. As a result, a dimension error of partner parts can be absorbed, resulting in no need to enhance the manufacture precision of the partner parts. Also, there is no need to enhance the dimension precision of the single busbar as compared with the mold parts, and the parts are easily manufactured.

The present invention is useful for providing a connector for direct installation in which no load is exerted on a fastening part of the connector when a partner connector is fastened thereto even if the respective alignments of busbar terminal groups of the connector are not ensured.

What is claimed is:

1. A connector comprising:

a busbar comprising:

a first connection part extending in a first direction;

a second connection part extending in a second direction opposite to the first direction at a position displaced from the first connection part in a direction orthogonal to the first direction; and a coupling part extending in a direction orthogonal to the first direction and the second direction, and coupling the first connection part and the second connection part;

a housing including at least one accommodation groove accommodating the coupling part, and a slit through which one of the first connection part and the second connection part is inserted; and a cover covering the accommodation groove, wherein the connector further comprises a plurality of busbars, each of which includes a first connection part, a second connection part, and a coupling part, the plurality of busbars sterically intersect with each other along the accommodation groove within the housing so that an alignment order of the plurality of busbars in the first connection part is different from an alignment order of the plurality of busbars in the second connection part, the housing includes at least two accommodation grooves accommodating the coupling part respectively, the accommodation grooves are formed in opposite sides of the housing respectively, and the cover, the busbar, and the housing are separate parts, and the coupling part of the busbar is sandwiched between the cover and the accommodation groove of the housing.

2. The connector of claim 1, wherein the connector comprises three busbars in which a first busbar corresponds to a U-phase voltage of an inverter, a second busbar corresponds to a V-phase voltage of the inverter, and a third busbar corresponds to a W-phase voltage of the inverter.

3. The connector of claim 1, wherein the coupling part of the busbar is configured to partially move while sandwiched between the cover and the accommodation groove of the housing.

4. A connector for direct installation on an inverter which is installed directly on the inverter for driving two three-phase loads by one inverter, the connector comprising:

six busbars having flat and elongated shape;

a housing formed with three narrow elongated spaces so as to accommodate the six busbars therein;

an upper cover covering a top of the housing in a vertical direction; and an under cover covering a bottom of the housing in the vertical direction, wherein each of the busbars includes a first busbar terminal, a second busbar terminal extending in a direction opposite to that of the first busbar terminal, and a coupling busbar coupling the first busbar terminal and the second busbar terminal, wherein the coupling busbar is connected to the first busbar terminal perpendicularly, extends by a predetermined length in a plane, turns perpendicularly and extends in the plane, turns perpendicularly to an opposite side with respect to the first busbar terminal in the plane, extends by a predetermined length, and is connected to the second busbar terminal perpendicularly, wherein two of the narrow elongated spaces are arranged in parallel with each other with an interval in a cross section orthogonal to an elongating direction thereof, and the other one of the narrow elongated spaces is arranged in a plane in which one of the two narrow elongated spaces is arranged at a side of the under cover, and wherein the coupling busbars are accommodated in the narrow elongated spaces with a clearance in a widthwise direction which is orthogonal to the elongating direction, so that both of the first busbar terminal and the second busbar terminal move in the vertical direction within the housing.

5. The connector as set forth in claim 4, wherein the coupling busbars of the busbars for a U phase and a W phase among the six busbars are accommodated in the two narrow elongated spaces arranged in parallel, and the coupling busbars of the busbars for a V phase are accommodated in the other one of the narrow elongated spaces.

* * * * *